US006635359B1

(12) United States Patent
Kurosaki et al.

(10) Patent No.: US 6,635,359 B1
(45) Date of Patent: Oct. 21, 2003

(54) ZN-AL-MG-SI-ALLOY PLATED STEEL PRODUCT HAVING EXCELLENT CORROSION RESISTANCE AND METHOD FOR PREPARING THE SAME

(75) Inventors: Masao Kurosaki, Futtsu (JP); Jun Maki, Kitakyushu (JP); Yasuhide Morimoto, Futtsu (JP); Kazumi Nishimura, Himeji (JP); Osamu Goto, Amagasaki (JP)

(73) Assignees: Nippon Steel Corporation, Tokyo (JP); Daido Steel Sheet Corporation, Hyogo (JP)

( * ) Notice: Subject to any disclaimer, the term of this patent is extended or adjusted under 35 U.S.C. 154(b) by 0 days.

(21) Appl. No.: 10/049,360

(22) PCT Filed: Aug. 9, 2000

(86) PCT No.: PCT/JP00/05342

§ 371 (c)(1),
(2), (4) Date: Feb. 8, 2002

(87) PCT Pub. No.: WO01/11100

PCT Pub. Date: Feb. 15, 2001

(30) Foreign Application Priority Data

Aug. 9, 1999 (JP) ..... 11/225023
Jul. 19, 2000 (JP) ..... 2000/218318

(51) Int. Cl.[7] ..... B32B 15/20

(52) U.S. Cl. ..... 428/653; 428/648; 428/659; 428/677; 428/678; 428/939

(58) Field of Search ..... 428/653, 648, 428/659, 677, 678, 939; 148/531, 533; 427/398.1, 398.2, 398.4, 431, 433

(56) References Cited

U.S. PATENT DOCUMENTS 3,026,606 A 3/1962 Nickola ..... 428/939
4,401,727 A * 8/1983 Berke et al. ..... 428/653

FOREIGN PATENT DOCUMENTS

| | | |
|---|---|---|
| GB | 2080833 | 2/1982 |
| JP | B-46-7161 | 2/1971 |
| JP | B-60-56420 | 12/1985 |
| JP | A-3-21627 | 3/1991 |
| JP | 2000-104153 | 4/2000 |

* cited by examiner

*Primary Examiner*—Robert R. Koehler
(74) *Attorney, Agent, or Firm*—Kenyon & Kenyon

(57) ABSTRACT

A Zn—Al—Mg—Si alloy-plated steel material with excellent corrosion resistance, characterized by comprising, in terms of wt %, Al: at least 45% and no greater than 70%, Mg: at least 3% and less than 10%, Si: at least 3% and less than 10%, with the remainder Zn and unavoidable impurities, wherein the Al/Zn ratio is 0.89–2.75 and the plating layer contains a bulky $Mg_2Si$ phase; also, a Zn—Al—Mg—Si alloy-plated steel material with excellent corrosion resistance, characterized by comprising, in terms of wt %, Al: at least 45% and no greater than 70%, Mg: at least 1% and less than 5%, Si: at least 0.5% and less than 3%, with the remainder Zn and unavoidable impurities, wherein the Al/Zn ratio is 0.89–2.75 and the plating layer contains a scaly $Mg_2Si$ phase.

14 Claims, 2 Drawing Sheets

ZN-AL-MG-SI-ALLOY PLATED STEEL PRODUCT HAVING EXCELLENT CORROSION RESISTANCE AND METHOD FOR PREPARING THE SAME

TECHNICAL FIELD

The present invention relates to a highly corrosion resistant Al—Zn—Mg—Si alloy-plated steel material and to a process for its production.

BACKGROUND ART

Zn plating of steel surfaces for improved corrosion resistance has been widely known in the prior art, and materials with Zn platings are currently produced in mass. Zn—Al alloy platings have even been proposed as a means of further improving corrosion resistance. Such an Zn—Al alloy plating is proposed in Japanese Patent No. 617,971. Specifically, there is disclosed an alloy plating comprising Al at 25–75%, Si at 0.5% or more of the Al content and with the remainder consisting of substantially Zn, wherein the Zn—Al alloy obtained exhibits excellent corrosion resistance as well as satisfactory adhesion to steel sheets and an attractive outer appearance. Such Zn—Al alloy platings provide especially excellent corrosion resistance compared to conventional Zn platings.

It is currently the situation, however, that when Zn—Al plated steel sheets fabricated in this manner are subjected to cutting, the exhibited corrosion resistance at the cut edges is insufficient. This occurs because, although corrosion of the steel sheet sections exposed at the cut edges is prevented by the sacrificial rusting effect of the Zn, the Zn component is lost from the Zn-segregated sections of the Zn—Al alloy plating layer, thus lowering the corrosion resistance. Also, when the plating layer is further coated with paint or laminated with a plastic film, the corrosion product resulting from selective corrosion of Zn accumulates, creating film blisters or so-called edge creep, and thus notably reducing the product value.

As a means of improving the corrosion resistance of cut edges of painted Zn—Al alloy platings, Japanese Patent No. 1,330,504 discloses an alloy plating containing Mg at 0.01–1.0% in a Zn—Al alloy layer, and although a slight effect is exhibited, the technique does not provide a thorough solution to the problem of edge corrosion. A similar technique is disclosed in Japanese Examined Patent Publication HEI No. 3-21627, as a plating which comprises 3–20% Mg, 3–15% Si and the remainder Al and Zn with an Al/Zn ratio of 1–1.5, and which is characterized by having a structure with Al-rich dendritic crystals as well as Zn-rich dendritic crystals and an intermetallic compound phase comprising $Mg_2Si$, $MgZn_2$, $SiO_2$ and $Mg_{32}(Al,Zn)_{49}$.

The results of experimentation by the present inventors have revealed that although plated steel sheets employing the platings disclosed in the prior art sometimes exhibit vastly improved corrosion resistance compared to Zn—Al plated steel sheets containing no Mg or Si, the workability of the platings differs depending on the Mg and Si content, and on the proportion and the form and size of the deposited $Mg_2Si$ phase, such that considerable variation is exhibited in terms of the corrosion resistance. Particularly as concerns the size of the $Mg_2Si$ phase, the observed size also differs depending on the method of observing the structure, and especially depending on the sample embedding angle when observing the cross-sectional composition, and it was found to be important to carry out measurement of the size by a more precise method while controlling the size.

It was also found that if the content of the deposited $Mg_2si$ phase is kept at above a certain value, even outside of the range of the composition disclosed in the aforementioned prior art, there exists a range in which the corrosion resistance is vastly improved compared to conventional Zn—Al plated steel sheets.

Another prior art example of controlling the amount of the $Mg_2Si$ phase in the plating phase is found in U.S. Pat. No. 3,026,606, which discloses a technique whereby the $Mg_2Si$ phase in the Al plating phase is controlled in a range of 4–25% and the thickness of the alloy phase produced at the interface between the plating phase and the base iron is minimized; however, the $Mg_2Si$ phase is not utilized as the means for improving corrosion resistance.

The present invention provides a highly corrosion resistant Zn—Al—Mg—Si alloy-plated steel sheet having a controlled content of Mg and Si added to a Zn—Al based plating and a controlled deposition amount and deposition form of the $Mg_2Si$ phase which exhibits an effect of improving corrosion resistance, as well as a process for its production.

DISCLOSURE OF THE INVENTION

As a result of diligent research aimed at solving the problems described above, the present inventors have completed the present invention upon finding that by adding Mg and Si in an appropriate range to Zn—Al alloy and controlling the structure thereof, it is possible to provide an alloy plating with not only unpainted corrosion resistance but also exceptional edge creep resistance at cut edge sections after painting, which has not been achievable by the prior art.

In other words, the gist of the present invention is as follows. (

1) A Zn—Al—Mg—Si alloy-plated steel material with excellent corrosion resistance, characterized by comprising, in terms of wt %, Al: at least 45% and no greater than 70%

Mg: at least 3% and less than 10%

Si: at least 3% and less than 10%, with the remainder Zn and unavoidable impurities, wherein the Al/Zn ratio is 0.89–2.75 and the plating layer contains a bulky $Mg_2Si$ phase.

(2) A Zn—Al—Mg—Si alloy-plated steel material with excellent corrosion resistance, characterized by comprising, in terms of wt %, Al: at least 45% and no greater than 70%

Mg: at least 1% and less than 5%

Si: at least 0.5% and less than 3%, with the remainder Zn and unavoidable impurities, wherein the Al/Zn ratio is 0.89–2.75 and the plating layer contains a scaly $Mg_2Si$ phase.

(3) A Zn—Al—Mg—Si alloy-plated steel material with excellent corrosion resistance according to (1) or (2) above, characterized by further comprising, as the Zn—Al—Mg—Si alloy plating composition, one or more from among In: 0.01–1.0%, Sn: 0.1–10.0%, Ca: 0.01–0.5%, Be: 0.01–0.2%, Ti: 0.01–0.2%, Cu: 0.1–1.0%, Ni: 0.01–0.2%, Co: 0.01–0.3%, Cr: 0.01–0.2%, Mn: 0.01–0.5%, Fe: 0.01–3.0% and Sr: 0.01–0.5%.

(4) A Zn—Al—Mg—Si alloy-plated steel material with excellent corrosion resistance, characterized in that the bulky $Mg_2Si$ phase of (1) above has a long diameter mean size of 3–50 $\mu$m, the area ratio of particles with a long diameter exceeding 100 $\mu$m is no more than 10% of the bulky $Mg_2Si$ phase, and the ratio of the short diameter to the long diameter is at least 0.4, as observed with a 5° inclination polished cross-section.

(5) A Zn—Al—Mg—Si alloy-plated steel material with excellent corrosion resistance, characterized in that the scaly $Mg_2Si$ phase of (2) above has a long diameter mean size of 3–50 μm, and the ratio of the short diameter to the long diameter is less than 0.4, as observed with a 5° inclination polished cross-section.

(6) A Zn—Al—Mg—Si alloy-plated steel material with excellent corrosion resistance according to (1), (3) or (4) above, characterized in that the total content of the bulky and scaly $Mg_2Si$ phases in the plating layer is 10–30% as the area ratio when observed with a 5° inclination polished cross-section, and the area ratio of bulky $Mg_2Si$ to the total $Mg_2Si$ phase is at least 1%.

(7) A Zn—Al—Mg—Si alloy-plated steel material with excellent corrosion resistance according to (2), (3) or (5) above, characterized in that the content of the scaly $Mg_2Si$ phase in the plating layer is at least 3% as the area ratio when observed with a 5° inclination polished cross-section.

(8) A Zn—Al—Mg—Si alloy-plated steel material with excellent corrosion resistance according to any one of (1) to (7) above, characterized by having a preplating layer containing one or more from among Ni, Co, Zn, Sn, Fe and Cu and/or an intermetallic compound phase comprising two or more from among Ni, Co, Zn, Sn, Fe and Cu, at the interface between the plating layer and the steel material.

(9) A Zn—Al—Mg—Si alloy-plated steel material with excellent corrosion resistance according to any one of (1) to (8) above, characterized in that the plating coverage per side is 20–130 g/m$^2$.

(10) A process for production of a Zn—Al—Mg—Si alloy-plated steel material with excellent corrosion resistance, which is a process for production of the Zn—Al—Mg—Si alloy-plated steel material according to (1) to (9) above characterized by keeping the temperature of the plating bath at 500–650° C. and controlling the cooling rate after plating to 10° C./sec or greater.

BEST MODE FOR CARRYING OUT THE INVENTION

Figure 1:
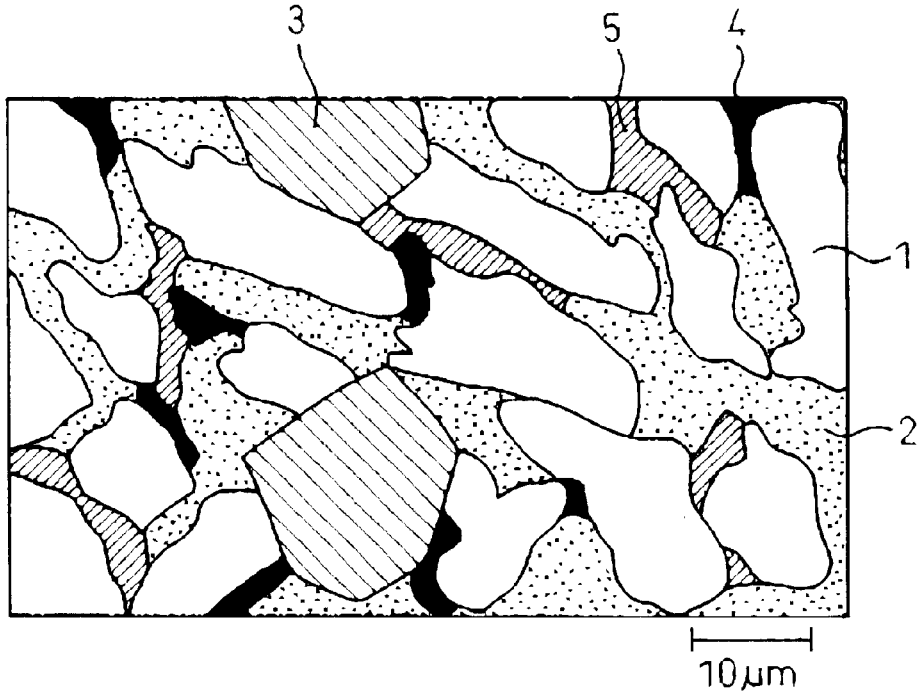
FIG. 1 shows an example of the 5° inclination polished cross-sectional structure of a plated steel sheet with a bulky $Mg_2Si$ phase in the plating layer according to the present invention.

The Al—Zn—Mg—Si based plating layer according to the invention is characterized by having a specific alloy structure, but first the basic plating composition of the plated steel sheet will be explained. The Mg in the plating phase provides an effect of improving the corrosion resistance of the plated steel material. Addition of Mg at 0.5% or greater (Throughout the present specification, the percentages given for addition of elements in the alloy composition will be in terms of wt % unless otherwise specified.) provides an effect of improved corrosion resistance in saline environments, but in order to exhibit stable corrosion resistance and effectively prevent edge creep after painting even in environments which are exposed to the outside atmosphere, addition of 1% or greater is necessary.

Although corrosion resistance is improved with increasing Mg addition, the corrosion resistance improving effect is saturated with addition of Mg in excess of 5% if the Si content of the plating layer is less than 3%. The reason for this is thought to be that when the Mg content is less than 5% the added Mg is deposited as a scaly $Mg_2Si$ phase, but when the Mg content exceeds 5% it is deposited as a $Mg_2Zn$ or $Mg_2Zn_{31}$, phase.

On the other hand, if the Si content of the plating layer is 3% or more, an Mg addition of less than 3% will not be expected to exhibit a corrosion inhibiting effect due to the presence of a free Si monophase. Deposition of a bulky $Mg_2Si$ phase begins when the Mg addition is 3% or greater, and further increase in the addition of Mg improves the corrosion resistance. However, when the amount of Mg added is increased still further, the viscosity of the bath gradually rises, impairing the manageability. If the amount of Mg added exceeds 10%, the deposited bulky $Mg_2Si$ phase increases too much while the thickness of the poorly workable Fe—Al alloy layer at the iron substrate interface also increases to the point of notably impairing the workability, resulting in reduced corrosion resistance.

In consideration of these factors, the preferred amount of Mg addition is at least 1% and less than 5% when the Si content is less than 3%, and at least 3% and less than 10% when the Si content is 3% or greater.

As regards the Si in the plating phase, if added in an amount of less than 0.5% a thick Fe—Al alloy layer is produced at the interface between the iron substrate and the plating phase and plating cracks are induced during working, thus making it impossible to achieve sufficient workability. This phenomenon occurs regardless of the amount of Mg added, and therefore the amount of Si added must be at least 0.5%.

If Si is added at 3% or greater when the Mg addition is less than 3%, a free Si phase is deposited, thus impairing the workability and significantly reducing the corrosion resistance. On the other hand, when the Mg addition is 3% or greater, increasing addition of Si results in greater deposition of the bulky $Mg_2Si$ phase and improved corrosion resistance. However, addition of Si at 10% or greater drastically reduces the corrosion resistance.

For these reasons, two appropriate ranges exist for addition of Mg and Si, one being a range in which Si is at least 0.5% and less than 3% and Mg is at least 1% and less than 5%, as the range in which a scaly $Mg_2Si$ phase is deposited. The other is a range in which Si is at least 3% and less than 10% and Mg is at least 3% and less than 10%, as the range in which scaly and bulky $Mg_2Si$ phases are deposited.

Persistent research by the present inventors on the Al/Zn ratio of the plating layer has revealed that the corrosion resistance-improving effect of the $Mg_2Si$ phase is more notable with a higher Al/Zn ratio. When the Al/Zn ratio is less than 0.89, the corrosion resistance does not reach that of the Zn—Al plated steel sheet containing 25–75% Al proposed in Japanese Patent No. 617,971 even if a $Mg_2Si$ phase is deposited. When the Al/Zn ratio is over 2.75, the plating bath temperature increases and hinders operation. From these considerations, the Al/Zn ratio of the plating layer was determined to be 0.89–2.75.

Figure 2:
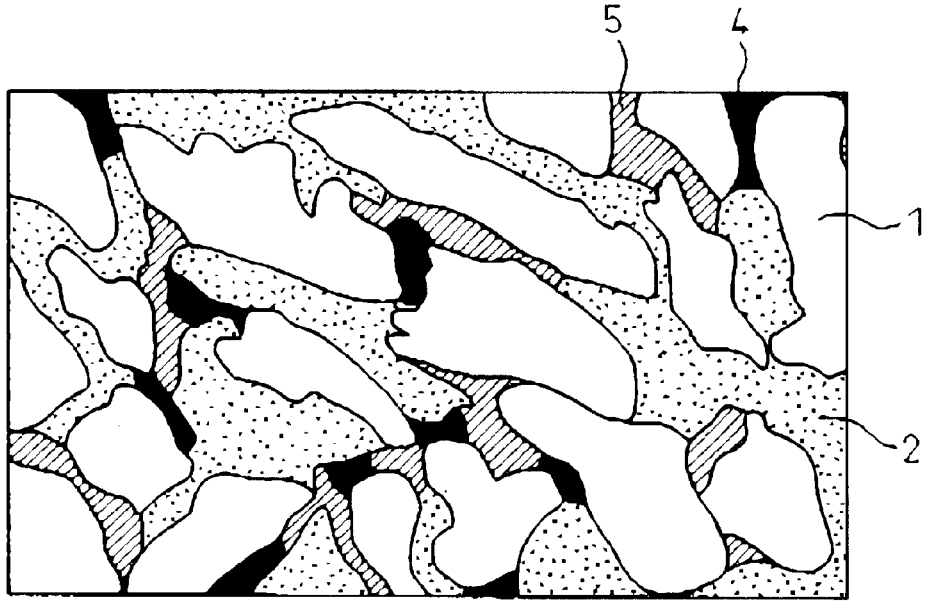
FIG. 2 shows an example of the 5° inclination polished cross-sectional structure of a plated steel sheet with a scaly $Mg_2Si$ phase in the plating layer according to the present invention.

Turning now to the metal structure of the plating layer, FIG. 1 and FIG. 2 schematically illustrate the structure of a plating layer according to the present invention, as observed after polishing the plating layer at a 5° inclination. FIG. 1 shows an embodiment of the present invention where the Al-rich dendritic phase 1 shown in white is a phase which has grown in a dendritic fashion, and it actually contains small amounts Zn, Mg, Si and Fe in solid solution. The Zn-rich dendritic phase 2 shown as the dotted regions is also a phase which has grown in a dendritic fashion, and it actually contains small amounts of Al, Mg, Si and Fe in solid solution. The bulky $Mg_2Si$ phase 3 is a deposited phase which has been deposited as polygonal shapes with sizes of about a few tens of micrometers, and this phase is produced during the initial process of plating aggregation. There are also dispersed and deposited $MgZn_2$ or $Mg_2Zn_{11}$ structures as Zn—Mg based intermetallic compounds denoted by reference numeral 4 and having shapes which fill the gaps between these phases, and a scaly $Mg_2Si$ phase denoted by reference numeral 5.

FIG. 2 is another embodiment of the present invention and it differs from FIG. 1 only in that the bulky $Mg_2Si$ phase 3 is not present.

Figure 3:
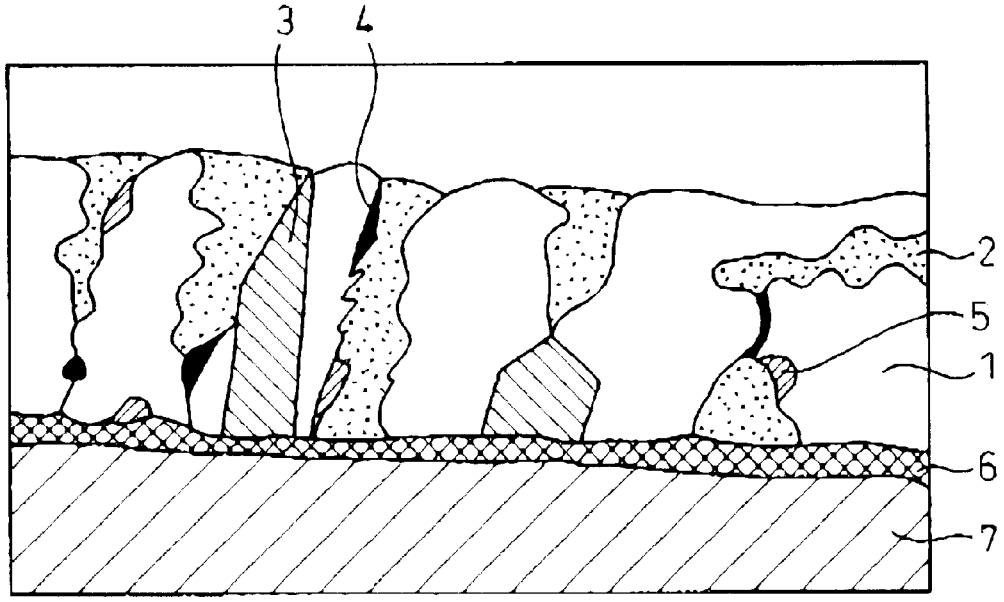
FIG. 3 shows an example of the perpendicular polished cross-sectional structure of a plated steel sheet with a bulky $Mg_2Si$ phase in the plating layer according to the present invention.
Figure 4:
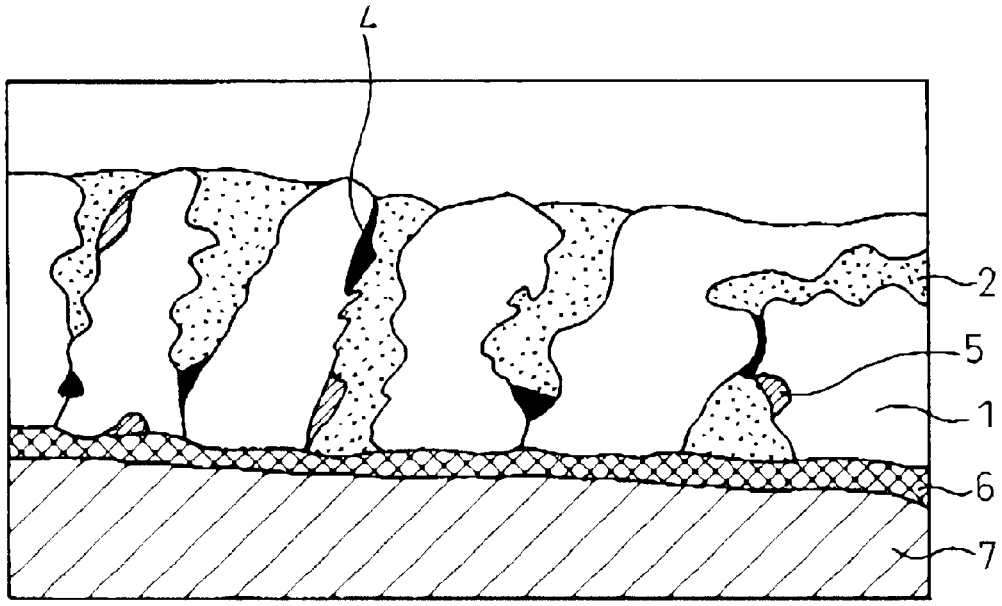
FIG. 4 shows an example of the perpendicular polished cross-sectional structure of a plated steel sheet with a scaly $Mg_2Si$ phase in the plating layer according to the present invention.

On the other hand, FIG. 3 and FIG. 4 shows the results of observing the structure after polishing the same sample perpendicular to its surface. The deposited phases corresponding to numerals in the drawings are the same as in FIGS. 1 and 2. Reference numeral 6 is an Fe—Al based alloy layer, and reference numeral 7 is the steel substrate. In FIG. 3 where a bulky $Mg_2Si$ phase is deposited, the size is smaller than in FIG. 1 as observed after polishing at a 5° inclination with respect to the horizontal direction, and only the local form can be seen. This is because even though the bulky $Mg_2Si$ phase is deposited in the state of polygonal plates spreading in the horizontal direction of the plating as the initial solidified phase, only a very small portion thereof can be observed when cutting is in the perpendicular direction by perpendicular polishing. In some cases, the size that can be confirmed with 5° inclination polishing reaches 10 or more times the size that can be confirmed with perpendicular polishing. Similarly, the $Mg_2Si$ phase deposited in a scaly form also differs considerably in the observable size depending on the polishing angle. This is because the scaly $Mg_2Si$ phase is deposited in a non-continuous manner in the gaps between the Al— and Zn— rich dendritic phases deposited in a dendritic fashion as the primary crystals.

Thus, in order to accurately determine the shape and size of the deposits, it is necessary to carry out polishing at an angle as close as possible to the horizontal to the plating surface, and it is an important aspect of the present invention that it was ascertained that the plating properties can be determined based on the size of the $Mg_2Si$ phase determined accurately in this manner.

As a result of much research on the polishing angle by the present inventors it was found that if an angle of 5° is maintained with respect to the horizontal direction, the size of the deposits that can be confirmed is roughly the same as by horizontal polishing, and that the size can be confirmed continuously from the plating surface layer to the base iron section.

The forms and shapes of the $Mg_2Si$ phase measured by this method will be described below.

The bulky $Mg_2Si$ phase is characterized in that the ratio of the short diameter with respect to the long diameter is 0.4 or greater, while the scaly $Mg_2Si$ phase is characterized in that the ratio of the short diameter with respect to the long diameter is less than 0.4.

When the amounts of Mg and Si addition are low, the $Mg_2Si$ phase is deposited in a scaly form. When the amounts of Mg and Si addition exceed 3%, deposition of a bulky $Mg_2Si$ phase is simultaneously produced. Deposition of a bulky $Mg_2Si$ phase is more satisfactory from the standpoint of corrosion resistance, but in this case the characteristic spangle of the Zn—Al based plating will be lost. Selection may be made depending on the need for spangle and the level of corrosion resistance required.

Regarding the size of the bulky $Mg_2Si$ phase, if the average value for the long diameter exceeds 50 $\mu$m, the particles act as origins for cracking, thus lowering the workability. Particularly, deposition of particles in excess of 100 $\mu$m induces peeling of the plating, and it is therefore necessary for the proportion of particles exceeding 100 $\mu$m in the deposited bulky $Mg_2Si$ phase to be controlled to no greater than 10%. Regarding the scaly $Mg_2Si$ phase as well, the average value for the long diameter must be controlled to no greater than 50 $\mu$m in order to ensure proper workability. The scaly $Mg_2Si$ phase will not induce peeling of the plating even if particles exceeding 100 $\mu$m are deposited, but sufficient workability can be ensured so long as the average value is controlled to no greater than 50 $\mu$m.

The size of the deposited $Mg_2Si$ phase is affected most predominantly by the cooling rate after hot-dip plating, and guaranteeing a cooling rate of at least 10° C./sec will allow the average value of the long diameter of either the bulky form or scaly form to be controlled to no greater than 50 $\mu$m. The cooling rate can be increased by controlling the coverage with a wiping nozzle after plating, and then accomplishing cooling by forced blowing of air or an inert gas such as nitrogen. Water mist may also be blown in if it is desired to further increase the cooling rate. The lower limit for the size of the $Mg_2Si$ phase is not particularly restricted, but for normal operation with production at a maximum cooling rate of 50° C./sec, deposition of a size of about a few $\mu$m is most common, and therefore 3 $\mu$m was established as the lower limit.

In order to sufficiently improve the corrosion resistance, the scaly $Mg_2Si$ phase content must be at least 3% in terms of area ratio as observed with 5° inclination polishing. Deposition of a bulky $Mg_2Si$ phase further improves the corrosion resistance, and particularly it is important for the proportion of the bulky $Mg_2Si$ phase to be greater than 1% with respect to the total $Mg_2Si$ phase. On the other hand, if the total area ratio of the scaly $Mg_2si$ phase and bulky $Mg_2Si$ phase exceeds 30% the workability is notably impaired, and therefore the upper limit is 30%.

The Zn—Al—Mg—Si alloy plating according to the invention is characterized by comprising one or more from among In: 0.01–1.0%, Sn: 0.1–10.0%, Ca: 0.01–0.5%, Be: 0.01–0.2%, Ti: 0.01–0.2%, Cu: 0.1–1.0%, Ni: 0.01–0.2%, Co: 0.01–0.3%, Cr: 0.01–0.2%, Mn: 0.01–0.5%, Fe: 0.01–3.0% and Sr: 0.01–0.5%. The purpose of adding one or more elements from among In, Sn, Ca, Be, Ti, Cu, Ni, CO, Cr, Mn, Fe and Sr is to further improve the plating corrosion resistance, as it is believed that addition of these elements further promotes passivation of the film produced on the plating surface. The effect of improving the corrosion resistance is exhibited when In, Sn, Ca, Be, Ti, Cu, Ni, Co, Cr, Mn, Fe and Sr are added to at least 0.01, 0.1, 0.01, 0.01, 0.01, 0.1, 0.01, 0.01, 0.01, 0.01, 0.01 and 0.01 wt %, respectively. On the other hand, if the addition amounts are too great a rough appearance is produced after plating, with generation of outer appearance defects due to, for example, dross, oxide adhesion and the like, and therefore the upper limits for addition of each of the elements In, Sn, Ca, Be, Ti, Cu, Ni, Co, Cr, Mn, Fe and Sr are 1.0, 10.0, 0.5, 0.2, 0.2, 1.0, 0.2, 0.3, 0.2, 0.5, 3.0 and 0.5 wt %, respectively.

Preplating may be carried out as pretreatment for the plating, in which case a preplating phase comprising one or more from among Ni, Co, Zn, Sn, Fe and Cu will be produced at the interface between the plating layer and the base iron. An intermetallic compound phase may also form by reaction of the preplating layer and the base iron and plating metal. A mixed phase of the preplating phase and an intermetallic compound phase may also result, but any of these situations are acceptable as they do not hinder the gist of the invention. Dissolution or dispersion of the preplating in the plating bath can result in the preplating components being present in the plating layer, but this does not hinder the gist of the invention. In particular, when this plating is applied for hot-rolled steel sheets or the like for the purpose of improving plating adhesion, it is effective to carry out preplating with Ni at about 0.5–1 g/m$^2$.

The plating coverage is preferably about 20–130 g/m$^2$ per side. Generally speaking, an increase in plating coverage is advantageous for the corrosion resistance, and disadvantageous for the workability and weldability. The preferred coverage will therefore differ depending on the purpose of use, but the coverage is preferably less for automobile parts which require excellent workability and weldability, and the coverage is preferably more for building materials and electric household appliances for which workability and weldability are not major requirements.

A post-treatment film such as a chemical treatment film or resin film may also be applied to the uppermost surface of the plating layer. This can provide an improving effect on the weldability, coating adhesion, corrosion resistance, etc. A chemical treatment film or resin film may contain one or more from among Si, C and P. Possible films include chromic acid-silica films, silica-phosphoric acid based films and silica-resin based films, employing such widely used resin types as acrylic, melamine, polyethylene, polyester, fluorine, alkyd, silicone-polyester and urethane based resins. The film thickness is not particularly restricted, and the treatment may usually be to about 0.5–20 $\mu$m. Post-treatment may, of course, be applied as chromating treatment or treatment with an inhibitor solution containing no chromium.

The steel components of the parent material will now be explained. No particular restrictions are placed on the steel components, and the effect of improvement in corrosion resistance is achieved for any type of steel. The steel type may be IF steel, Al-k steel, Cr-containing steel, stainless steel, high tension steel or the like, with addition of Ti, Nb, B, etc. Al-k steel or stainless steel is preferred for construction material purposes, Ti-IF steel is preferred for exhaust pipe purposes, Al-k steel is preferred for electrical appliance purposes, and B-added IF steel is preferred for fuel tank purposes.

The plating bath temperature should not be below 500° C. to avoid raising the viscosity of the plating solution and thus hindering operation. On the other hand, a temperature exceeding 650° C. increases the alloy layer thickness produced at the steel/plating interface, thus impairing the workability and corrosion resistance while also promoting dissolution loss of the plating equipment.

EXAMPLES

Example 1 and Comparative Example 1

A cold-rolled steel sheet (sheet thickness: 0.8 mm) subjected to ordinary hot rolling and cold rolling was used as the material for hot-dip Zn—Al—Mg—Si plating. The plating was accomplished using a non-oxidizing furnace/reducing furnace type line, and plating coverage adjustment by gas wiping after plating was followed by cooling and zero spangle treatment. The composition of the plating bath was varied to produce test materials, and their properties were investigated. Fe was present in the bath at about 1–2% as an unavoidable impurity supplied from the plating machine and strips in the bath. The bath temperature was 600–650° C. The obtained plated steel sheet was provided for stripping and plating composition and coverage measurement by chemical analysis methods, and the plating structure was observed with an optical microscope after 5° inclination polishing. The corrosion resistance, workability, and weldability were simultaneously evaluated by the following methods. The results are shown in Table 1.

(1) Corrosion Resistance Evaluation i) Salt Corrosion Resistance

A test sample with dimensions of 70×150 mm was subjected to a salt spray test according to JIS Z2371 for 30 days, and after stripping off the corrosion product, the corrosion loss was measured. The corrosion loss values shown are for one plated side.

Evaluation Scale

◎: Corrosion loss of ≦5 g/m$^2$

○: Corrosion loss of <10 g/m$^2$

Δ: Corrosion loss of 10–25 g/m$^2$

X: Corrosion loss of >25 g/m$^2$ ii) Painted Corrosion Resistance

First, one side was subjected to chromic acid-silica based treatment to 20 mg/m$^2$ based on metallic Cr, as chemical treatment. Next, a test sample with dimensions of 70×150 mm was subjected to 20 $\mu$m melamine-based black painting, and baked at 140° C. for 20 minutes. A crosscut was then formed and the sample was provided for a salt spray test. The outer appearance after 60 days was visually observed.

Evaluation Scale

◎: No red rust

○: No red rust outside of crosscut

Δ: Red rust ratio ≦5%

X: Red rust ratio >5% iii) Outdoor Exposure Test

The sample was painted after the chemical treatment described in ii) above. The painting was carried out with two types of paints, a polyethylene wax-containing acrylic-based resin (clear: 5 $\mu$m) and an epoxy-based resin (20 $\mu$m). After shearing to dimensions of 50×200 mm, the sample was subjected to an outdoor exposure test. The red rust ratio and surface coloration condition were observed from the edge after a period of 3 months.

Evaluation Scale

◎: Red rust ratio from edge <30%

ΔA: Red rust ratio from edge 30–80%

X: Red rust ratio from edge >80%

(2) Weldability

After the chemical treatment described in ii) above, spot welding was conducted under the welding conditions shown below, and the number of continuous spots until the nugget diameter reduced to below 4√t (t: sheet thickness) was evaluated.

Welding Conditions

Welding current: 10 kA, Pressure force: 220 kg, welding time: 12 cycles, Electrode diameter: 6 mm, Electrode shape: dome-shape, Tip: 6ϕ-40R Evaluation Scale ◎: Number of continuous spots >700

Δ: Number of continuous spots 400–700

○: Number of continuous spots <400

(3) Workability

A cylindrical punch with a 50 mm diameter was used in a hydraulic molding tester for cup molding at a draw ratio of 2.25. The test was carried out with application of oil, and the flattening force was 500 kg. The workability was evaluated on the following scale.

Evaluation Scale

○: No defects

Δ: Cracks in plating

X: Peeling of plating

TABLE 1

| | Plating components (%) | | | | | | Coverage | $Mg_2Si$ | | | | | |
|---|---|---|---|---|---|---|---|---|---|---|---|---|---|
| | Al | Zn | Mg | Si | Fe | Al/Zn | (g/m$^2$) | Form | Long diameter (μm) | Volume (%) | Bulky $Mg_2Si$ proportion (%) | Long diameter average (μm) | Proportion with long diameter >100μ |
| | | | | | | | | Present Invention | | | | | |
| 1 | 46 | 45.4 | 4 | 3.5 | 1.1 | 1.01 | 30 | scaly + bulky | 40 | 10.5 | 18 | 40 | 2 |
| 2 | 48 | 35.8 | 7 | 8 | 1.2 | 1.34 | 40 | scaly + bulky | 35 | 22.5 | 60 | 35 | 0 |
| 3 | 50 | 28.5 | 9.5 | 9.3 | 1.5 | 1.75 | 35 | scaly + bulky | 30 | 29.5 | 71 | 30 | 0 |
| 4 | 55 | 36.8 | 3.5 | 3.5 | 1.2 | 1.49 | 50 | scaly + bulky | 32 | 10 | 9 | 32 | 0 |
| 5 | 55 | 31.7 | 7.5 | 4.8 | 1 | 1.74 | 70 | scaly + bulky | 45 | 15.1 | 41 | 45 | 5 |
| 6 | 58 | 26.9 | 9 | 5 | 1.1 | 2.16 | 50 | scaly + bulky | 42 | 21.2 | 56 | 42 | 1 |
| 7 | 62 | 28 | 4 | 5 | 1 | 2.21 | 65 | scaly + bulky | 42 | 13.5 | 33 | 42 | 2 |
| 8 | 63 | 26.6 | 4.5 | 5 | 0.9 | 2.37 | 50 | scaly + bulky | 25 | 14.4 | 38 | 25 | 0 |
| 9 | 68 | 25 | 3 | 3 | 1 | 2.72 | 55 | scaly + bulky | 23 | 10 | 10 | 23 | 0 |
| 10 | 46 | 50.9 | 1.5 | 0.6 | 1 | 0.90 | 50 | scaly | 45 | 3 | 0 | 45 | 0 |
| 11 | 50 | 44.9 | 3 | 1 | 1.1 | 1.11 | 45 | scaly | 46 | 6 | 0 | 46 | 0 |
| 12 | 58 | 36 | 3.5 | 1.5 | 1 | 1.61 | 55 | scaly | 42 | 9 | 0 | 42 | 0 |
| 13 | 65 | 27.2 | 5 | 2 | 0.8 | 2.39 | 70 | scaly | 40 | 7.2 | 0 | 40 | 0 |
| 14 | 70 | 24.1 | 3 | 2 | 0.9 | 2.90 | 55 | scaly | 38 | 7.5 | 0 | 38 | 0 |
| | | | | | | | | Comparative Examples | | | | | |
| 15 | 50 | 45.1 | 0.5 | 3.5 | 0.9 | 1.11 | 60 | scaly | 30 | 1.5 | 0 | 30 | 0 |
| 16 | 50 | 27 | 15 | 7 | 1 | 1.85 | 65 | scaly + bulky | 23 | 21 | 57 | 23 | 1 |
| 17 | 55 | 37.8 | 5 | 1 | 1.2 | 1.46 | 70 | scaly | 42 | 3.2 | 0 | 42 | 0 |
| 18 | 55 | 22.5 | 6 | 15 | 1.5 | 2.44 | 70 | scaly + bulky | 23 | 20.1 | 55 | 23 | 0 |
| 19 | 50 | 33.5 | 8 | 7 | 1.5 | 1.49 | 35 | scaly + bulky | 75 | 23.2 | 61 | 75 | 15 |
| 20 | 50 | 33.5 | 8 | 7 | 1.5 | 1.49 | 10 | scaly + bulky | 42 | 23.5 | 62 | 42 | 2 |
| 21 | 50 | 33.5 | 8 | 7 | 1.5 | 1.49 | 140 | scaly + bulky | 42 | 22 | 59 | 42 | 1 |
| 22 | 25 | 58.5 | 8 | 7 | 1.5 | 0.43 | 70 | scaly + bulky | 42 | 24.2 | 63 | 42 | 2 |
| 23 | 55 | 41.6 | 0.1 | 2 | 1.3 | 1.32 | 40 | none | — | — | — | — | — |
| 24 | 60 | 30.3 | 7 | 1.5 | 1.2 | 1.98 | 55 | scaly | 38 | 3 | 0 | 38 | 0 |
| 25 | 58 | 37.5 | 3 | 0.2 | 1.3 | 1.55 | 40 | none | — | — | — | — | — |
| 26 | 52 | 39.8 | 2 | 5 | 1.2 | 1.31 | 50 | scaly | 31 | 6 | 0 | 31 | 0 |
| 27 | 56 | 38.7 | 3 | 1 | 1.3 | 1.45 | 45 | scaly | 85 | 3.2 | 0 | 85 | 5 |
| 28 | 55 | 38.5 | 3 | 2 | 1.5 | 1.43 | 11 | scaly | 38 | 5.2 | 0 | 38 | 0 |
| 29 | 58 | 35.9 | 3 | 2 | 1.1 | 1.62 | 150 | scaly | 31 | 4.8 | 0 | 31 | 0 |
| 30 | 30 | 63.8 | 3 | 2 | 1.2 | 0.47 | 70 | scaly | 30 | 5 | 0 | 30 | 0 |

| | Bath temperature (° C.) | Cooling rate (° C./sec) | Corrosion resistance: Salt corrosion | Corrosion resistance: Painting | Corrosion resistance: Exposure | Weld-ability | Work-ability | Overall evaluation |
|---|---|---|---|---|---|---|---|---|
| | | | | Present Invention | | | | |
| 1 | 630 | 25 | ◎ | ◎ | ◎ | ○ | ○ | ◎ |
| 2 | 640 | 30 | ◎ | ◎ | ◎ | ○ | ○ | ◎ |
| 3 | 630 | 35 | ◎ | ◎ | ◎ | ○ | ○ | ◎ |
| 4 | 630 | 30 | ◎ | ◎ | ◎ | ○ | ○ | ◎ |
| 5 | 640 | 20 | ◎ | ◎ | ◎ | ○ | ○ | ◎ |
| 6 | 630 | 25 | ◎ | ◎ | ◎ | ○ | ○ | ◎ |
| 7 | 640 | 25 | ◎ | ◎ | ◎ | ○ | ○ | ◎ |
| 8 | 630 | 40 | ◎ | ◎ | ◎ | ○ | ○ | ◎ |
| 9 | 640 | 40 | ◎ | ◎ | ◎ | ○ | ○ | ◎ |
| 10 | 630 | 15 | ○ | ○ | ○ | ○ | ○ | ○ |
| 11 | 610 | 15 | ○ | ○ | ○ | ○ | ○ | ○ |
| 12 | 620 | 20 | ◎ | ◎ | ◎ | ○ | ○ | ◎ |
| 13 | 600 | 20 | ○ | ○ | ○ | ○ | ○ | ○ |
| 14 | 570 | 25 | ○ | ○ | ○ | ○ | ○ | ○ |

TABLE 1-continued

| | | | | | | | | | |
|---|---|---|---|---|---|---|---|---|---|
| | | | | Comparative Examples | | | | | |
| 15 | 630 | 35 | Δ | Δ | Δ | ○ | ○ | Δ | 1 Low Mg |
| 16 | 640 | 40 | ○ | ○ | ○ | ○ | x | x | 1 High Mg |
| 17 | 620 | 25 | Δ | Δ | Δ | ○ | x | x | 1 Low Si |
| 18 | 640 | 40 | x | x | x | ○ | x | x | 1 High Si |
| 19 | 630 | 5 | ◎ | ◎ | ◎ | ○ | x | x | 1 Insuff. cool. rate |
| 20 | 620 | 25 | x | x | x | ○ | ○ | x | 1 Insuff. plat. cover. |
| 21 | 620 | 25 | ◎ | ◎ | ◎ | x | x | x | 1 High plat. cover. |
| 22 | 620 | 25 | Δ | Δ | Δ | ○ | ○ | Δ | 1 Low Al/Zn ratio |
| 23 | 630 | 30 | Δ | Δ | Δ | ○ | ○ | Δ | 2 Low Mg |
| 24 | 620 | 25 | ○ | ○ | ○ | ○ | Δ | Δ | 2 High Mg |
| 25 | 600 | 35 | Δ | Δ | Δ | ○ | x | x | 2 Low Si |
| 26 | 620 | 35 | x | x | x | ○ | x | x | 2 High Si |
| 27 | 600 | 3 | ○ | ○ | ○ | ○ | Δ | Δ | 2 Insuff. cool. rate |
| 28 | 590 | 25 | x | x | x | ○ | ○ | x | 2 Insuff. plat. cover. |
| 29 | 580 | 30 | ○ | ○ | ○ | x | Δ | x | 2 High plat. cover. |
| 30 | 600 | 35 | Δ | Δ | Δ | ○ | ○ | Δ | 2 Low Al/Zn ratio |

As comparative examples there are shown materials with slight addition of Mg (Sample Nos. 15 and 23), but both of these exhibited insufficient corrosion resistance in the severe corrosion environments described above. With addition of excess amounts of Mg as with Sample Nos. 16 and 24, the workability was impaired and the corrosion resistance was consequently insufficient. On the other hand, Sample Nos. 17 and 25 which had insufficient amounts of Si addition had thicker alloy layers and exhibited inferior workability as well as insufficient corrosion resistance, while conversely, Sample Nos. 18 and 26 which had excessive amounts of addition of Si exhibited inferior workability and corrosion resistance due to the effect of Si being deposited in the plating layer.

From the standpoint of the production conditions, Sample Nos. 19 and 27 which were cooled at insufficient cooling rates after plating had enlarged deposited $Mg_2Si$ phases and inferior workability. Sample Nos. 20 and 28 which had inadequate plating coverage exhibited insufficient corrosion resistance, while Sample Nos. 21 and 29 which had excessive coverage exhibited inadequate workability and weldability.

Sample Nos. 22 and 30 which had low Al/Zn ratios did not exhibit an adequate effect by the $Mg_2Si$ phase, and the resulting corrosion resistance was inferior.

On the other hand, the invention example as represented by all of Sample Nos. 1–14 exhibited excellent properties for all of the evaluated parameters. The important property of corrosion resistance was particularly satisfactory when Mg and Si were higher within their appropriate ranges.

Examples 2 and Comparative Example 2

A cold-rolled steel sheet with a thickness of 0.8 mm was used as the material for hot-dip plating by immersion for 3 seconds in a Zn—Al—Mg—Si alloy plating bath at a bath temperature of 630° C. The plating coverage was adjusted to 90 g/m$^2$ by gas wiping after plating, and then cooling was effected at a rate of 30° C./sec.

The compositions of the plating layers of each of the obtained Zn—Al—Mg—Si based steel sheets were as shown in Tables 2 and 3. The corrosion resistance was also evaluated by the methods described below. The results are shown in Tables 2 and 3. The structures of these platings as observed after 5° inclination polishing, at least in the case of Example 2 (Sample Nos. 31–43) as in Example 1, were structures comprising a bulky and scaly $Mg_2Si$ phase as defined according to the invention.

(1) Corrosion Resistance Evaluation i) Salt Corrosion Resistance

A test sample with dimensions of 70×150 mm was subjected to a salt spray test according to JIS Z2371 for 30 days, and after stripping off the corrosion product, the corrosion loss was measured. The corrosion loss values shown are for one plated side.

Evaluation scale

◎: Corrosion loss of ≦5 g/m$^2$

○: Corrosion loss of <10 g/m$^2$

Δ: Corrosion loss of 10–25 g/m$^2$

X: Corrosion loss of >25 g/m$^2$ ii) Painted Corrosion Resistance

First, one side was subjected to chromic acid-silica based treatment to 20 mg/m$^2$ based on metallic Cr, as chemical treatment. Next, a test sample with dimensions of 70×150 mm was subjected to 20 μm melamine-based black painting, and baked at 140° C. for 20 minutes. A crosscut was then formed and the sample was provided for a salt spray test. The outer appearance after 60 days was visually observed.

Evaluation Scale

◎: No red rust

○: No red rust outside of crosscut

Δ: Red rust ratio ≦5%

X: Red rust ratio >5%

TABLE 2

| | Hot-dip Zn—Al—Mg—Si plating layer composition (wt %) | | | | | | | | | | | | | | | Corrosion resistance | | |
|---|---|---|---|---|---|---|---|---|---|---|---|---|---|---|---|---|---|---|
| | Al | Mg | Si | In | Sn | Ca | Be | Ti | Cu | Ni | Co | Cr | Mn | Fe | Sr | Salt corrosion | Paint layer | |
| 31 | 55 | 5 | 5 | 0.5 | 0.1> | 0.01> | 0.01> | 0.01> | 0.1> | 0.01> | 0.01> | 0.01> | 0.01> | 0.01> | 0.01> | ◎ | ◎ | Inv. |
| 32 | 55 | 5 | 5 | 0.01> | 2 | 0.01> | 0.01> | 0.01> | 0.1> | 0.01> | 0.01> | 0.01> | 0.01> | 0.01> | 0.01> | ◎ | ◎ | Exs. |
| 33 | 55 | 5 | 5 | 0.01> | 0.1> | 0.1 | 0.01> | 0.01> | 0.1> | 0.01> | 0.01> | 0.01> | 0.01> | 0.01> | 0.01> | ◎ | ◎ | |
| 34 | 55 | 5 | 5 | 0.01> | 0.1> | 0.01> | 0.05 | 0.01> | 0.1> | 0.01> | 0.01> | 0.01> | 0.01> | 0.01> | 0.01> | ◎ | ◎ | |
| 35 | 55 | 5 | 5 | 0.01> | 0.1> | 0.01> | 0.01> | 0.1 | 0.1> | 0.01> | 0.01> | 0.01> | 0.01> | 0.01> | 0.01> | ◎ | ◎ | |
| 36 | 55 | 5 | 5 | 0.01> | 0.1> | 0.01> | 0.01> | 0.01> | 0.3 | 0.01> | 0.01> | 0.01> | 0.01> | 0.01> | 0.01> | ◎ | ◎ | |
| 37 | 55 | 5 | 5 | 0.01> | 0.1> | 0.01> | 0.01> | 0.01> | 0.1> | 0.05 | 0.01> | 0.01> | 0.01> | 0.01> | 0.01> | ◎ | ◎ | |
| 38 | 55 | 5 | 5 | 0.01> | 0.1> | 0.01> | 0.01> | 0.01> | 0.1> | 0.01> | 0.1 | 0.01> | 0.01> | 0.01> | 0.01> | ◎ | ◎ | |
| 39 | 55 | 5 | 5 | 0.01> | 0.1> | 0.01> | 0.01> | 0.01> | 0.1> | 0.01> | 0.01> | 0.05 | 0.01> | 0.01> | 0.01> | ◎ | ◎ | |
| 40 | 55 | 5 | 5 | 0.01> | 0.1> | 0.01> | 0.01> | 0.01> | 0.1> | 0.01> | 0.01> | 0.01> | 0.2 | 0.01> | 0.01> | ◎ | ◎ | |
| 41 | 55 | 5 | 5 | 0.01> | 0.1> | 0.01> | 0.01> | 0.01> | 0.1> | 0.01> | 0.01> | 0.01> | 0.01> | 1.1 | 0.01> | ◎ | ◎ | |
| 42 | 55 | 5 | 5 | 0.01> | 0.1> | 0.01> | 0.01> | 0.01> | 0.1> | 0.01> | 0.01> | 0.01> | 0.01> | 0.01> | 0.1 | ◎ | ◎ | |
| 43 | 55 | 5 | 5 | 0.01> | 0.1> | 0.01> | 0.01> | 0.01> | 0.1> | 0.01> | 0.01> | 0.01> | 0.01> | 1.1 | 0.01> | ◎ | ◎ | |
| 44 | 55 | 5 | 5 | 0.01> | 1 | 0.01> | 0.01> | 0.01> | 0.1> | 0.01> | 0.01> | 0.01> | 0.01> | 1.1 | 0.01> | ◎ | ◎ | |
| 45 | 55 | 5 | 5 | 0.01> | 0.1> | 0.2 | 0.01> | 0.01> | 0.1> | 0.01> | 0.01> | 0.01> | 0.01> | 1.1 | 0.01> | ◎ | ◎ | |
| 46 | 55 | 5 | 5 | 0.01> | 0.1> | 0.01> | 0.1 | 0.01> | 0.1> | 0.01> | 0.01> | 0.01> | 0.01> | 1.1 | 0.01> | ◎ | ◎ | |
| 47 | 55 | 5 | 5 | 0.01> | 0.1> | 0.01> | 0.01> | 0.05 | 0.1> | 0.01> | 0.01> | 0.01> | 0.01> | 1.1 | 0.01> | ◎ | ◎ | |
| 48 | 55 | 5 | 5 | 0.01> | 0.1> | 0.01> | 0.01> | 0.01> | 0.5 | 0.01> | 0.01> | 0.01> | 0.01> | 1.1 | 0.01> | ◎ | ◎ | |
| 49 | 55 | 5 | 5 | 0.01> | 0.1> | 0.01> | 0.01> | 0.01> | 0.1> | 0.1 | 0.01> | 0.01> | 0.01> | 1.1 | 0.01> | ◎ | ◎ | |
| 50 | 55 | 5 | 5 | 0.01> | 0.1> | 0.01> | 0.01> | 0.01> | 0.1> | 0.01> | 0.1 | 0.01> | 0.01> | 1.1 | 0.01> | ◎ | ◎ | |
| 51 | 55 | 5 | 5 | 0.01> | 0.1> | 0.01> | 0.01> | 0.01> | 0.1> | 0.01> | 0.01> | 0.1 | 0.01> | 1.1 | 0.01> | ◎ | ◎ | |
| 52 | 55 | 5 | 5 | 0.01> | 0.1> | 0.01> | 0.01> | 0.01> | 0.1> | 0.01> | 0.01> | 0.01> | 0.3 | 1.1 | 0.01> | ◎ | ◎ | |
| 53 | 55 | 5 | 5 | 0.01> | 0.1> | 0.01> | 0.01> | 0.01> | 0.1> | 0.01> | 0.01> | 0.01> | 0.01> | 1.1 | 0.3 | ◎ | ◎ | |

TABLE 3

| | Hot-dip Zn—Al—Mg—Si plating layer composition (wt %) | | | | | | | | | | | | | | | Corrosion resistance | | |
|---|---|---|---|---|---|---|---|---|---|---|---|---|---|---|---|---|---|---|
| | Al | Mg | Si | In | Sn | Ca | Be | Ti | Cu | Ni | Co | Cr | Mn | Fe | Sr | Salt corrosion | Paint layer | |
| 54 | 55 | 5 | 5 | 1.2 | 0.1> | 0.01> | 0.01> | 0.01> | 0.1> | 0.01> | 0.01> | 0.01> | 0.01> | 0.01> | 0.01> | Δ | Δ | Comp. |
| 55 | 55 | 5 | 5 | 0.01> | 15 | 0.01> | 0.01> | 0.01> | 0.1> | 0.01> | 0.01> | 0.01> | 0.01> | 0.01> | 0.01> | Δ | Δ | Ex. |
| 56 | 55 | 5 | 5 | 0.01> | 0.1> | 0.8 | 0.01> | 0.01> | 0.1> | 0.01> | 0.01> | 0.01> | 0.01> | 0.01> | 0.01> | Δ | Δ | |
| 57 | 55 | 5 | 5 | 0.01> | 0.1> | 0.01> | 0.25 | 0.01> | 0.1> | 0.01> | 0.01> | 0.01> | 0.01> | 0.01> | 0.01> | Δ | Δ | |
| 58 | 55 | 5 | 5 | 0.01> | 0.1> | 0.01> | 0.01> | 0.23 | 0.1> | 0.01> | 0.01> | 0.01> | 0.01> | 0.01> | 0.01> | Δ | Δ | |
| 59 | 55 | 5 | 5 | 0.01> | 0.1> | 0.01> | 0.01> | 0.01> | 1.1 | 0.01> | 0.01> | 0.01> | 0.01> | 0.01> | 0.01> | Δ | Δ | |
| 60 | 55 | 5 | 5 | 0.01> | 0.1> | 0.01> | 0.01> | 0.01> | 0.1> | 0.22 | 0.01> | 0.01> | 0.01> | 0.01> | 0.01> | Δ | Δ | |
| 61 | 55 | 5 | 5 | 0.01> | 0.1> | 0.01> | 0.01> | 0.01> | 0.1> | 0.01> | 0.34 | 0.01> | 0.01> | 0.01> | 0.01> | Δ | Δ | |
| 62 | 55 | 5 | 5 | 0.01> | 0.1> | 0.01> | 0.01> | 0.01> | 0.1> | 0.01> | 0.01> | 0.21 | 0.01> | 0.01> | 0.01> | Δ | Δ | |
| 63 | 55 | 5 | 5 | 0.01> | 0.1> | 0.01> | 0.01> | 0.01> | 0.1> | 0.01> | 0.01> | 0.01> | 0.52 | 0.01> | 0.01> | Δ | Δ | |
| 64 | 55 | 5 | 5 | 0.01> | 0.1> | 0.01> | 0.01> | 0.01> | 0.1> | 0.01> | 0.01> | 0.01> | 0.01> | 3.2 | 0.01> | Δ | Δ | |
| 65 | 55 | 5 | 5 | 0.01> | 0.1> | 0.01> | 0.01> | 0.01> | 0.1> | 0.01> | 0.01> | 0.01> | 0.01> | 0.01> | 0.52 | Δ | Δ | |

Industrial Applicability

The present invention provides surface-treated steel sheets with high corrosion resistance of the plating layers as well as highly satisfactory edge creep resistance after painting. Their use may be applied for virtually all conventional surface-treated steel sheets, and the contribution to industry is therefore highly significant.

What is claimed is:

1. A Zn—Al—Mg—Si alloy-plated steel material with excellent corrosion resistance, characterized by comprising, in terms of wt %, Al: at least 45% and no greater than 70%

Mg: at least 3% and less than 10%

Si: at least 3% and less than 10%, with the remainder Zn and unavoidable impurities, wherein the Al/Zn ratio is 0.89–2.75 and the plating layer contains a bulky $Mg_2Si$ phase.

2. A Zn—Al—Mg—Si alloy-plated steel material with excellent corrosion resistance, characterized by comprising, in terms of wt %, Al: at least 45% and no greater than 70%

Mg: at least 1% and less than 5%

Si: at least 0.5% and less than 3%, with the remainder Zn and unavoidable impurities, wherein the Al/Zn ratio is 0.89–2.75 and the plating layer contains a scaly $Mg_2Si$ phase.

3. A Zn—Al—Mg—Si alloy-plated steel material with excellent corrosion resistance, characterized in that the bulky $Mg_2Si$ phase of claim 1 has a long diameter mean size of 3–50 $\mu$m, the area ratio of particles with a long diameter exceeding 100 $\mu$m is no more than 10% of the bulky $Mg_2Si$ phase, and the ratio of the short diameter to the long diameter is at least 0.4, as observed with a 5° inclination polished cross-section.

4. A Zn—Al—Mg—Si alloy-plated steel material with excellent corrosion resistance, characterized in that the scaly $Mg_2Si$ phase of claim 2 has a long diameter mean size of 3–50 μm. and the ratio of the short diameter to the long diameter is less than 0.4, as observed with a 5° inclination polished cross-section.

5. A Zn—Al—Mg—Si alloy-plated steel material with excellent corrosion resistance according to claims characterized in that the total content of the bulky and scaly $Mg_2Si$ phases in the plating layer is 10–30% as the area ratio when observed with a 5° inclination polished cross-section, and the area ratio of bulky $Mg_2Si$ to the total $Mg_2Si$ is at least 1%.

6. A Zn—Al—Mg—Si alloy-plated steel material with excellent corrosion resistance according to claim 4 characterized in that the content of the scaly $Mg_2Si$ phase in the plating layer is at least 3% as the area ratio when observed with a 5° inclination polished cross-section.

7. A Zn—Al—Mg—Si alloy-plated steel material with excellent corrosion resistance according to claim 1, characterized by further comprising, as the Zn—Al—Mg—Si alloy plating composition, one or more from among In: 0.01–1.0%, Sn: 0.1–10.0%, Ca: 0.01–0.5%, Be: 0.01–0.2%, Ti: 0.01–0.2%, Cu: 0.1–1.0%, Ni: 0.01–0.2%, Co: 0.01–0.3%, Cr: 0.01–0.2%, Mn: 0.01–0.5%, Fe, 0.01–3.0% and Sr: 0.01–0.5%.

8. A Zn—Al—Mg—Si alloy-plated steel material with excellent corrosion resistance according to claim 2, characterized by further comprising, as the Zn—Al—Mg—Si alloy plating composition, one or more from among In: 0.01–1.0%, Sn: 0.1–10.0%, Ca: 0.01–0.5%, Be: 0.01–0.2%, Ti: 0.01–0.2%, Cu: 0.1–1.0%, Ni: 0.01–0.2%, Co: 0.01–0.3%, Cr: 0.01–0.2%, Mn: 0.0.01–0.5%, Fe: 0.01–3.0% and Sr: 0.01–0.5%.

9. A Zn—Al—Mg—Si alloy-plated steel material with excellent corrosion resistance according to claim 1, characterized in that the total content of the bulky and scaly $Mg_2Si$ phases in the plating layer is 10–30% as the area ratio when observed with a 5° inclination polished cross-section, and the area ratio of bulky $Mg_2Si$ to the total $Mg_2Si$ phase is at least 1%.

10. A Zn—Al—Mg—Si alloy-plated steel material with excellent corrosion resistance according to claim 2, characterized in that the content of the scaly $Mg_2Si$ phase in the plating layer is at least 3% as the area ratio when observed with a 5% inclination polished cross-section.

11. A Zn—Al—Mg—Si alloy-plated steel material with excellent corrosion resistance according to claim 1, characterized by having a preplating layer containing one or more from among Ni, Co, Zn, Sn, Fe and Cu and/or the intermetallic compound phase comprising two or more from among Ni, Co, Zn, Sn, Fe and Cu, at the interface between the plating layer and the steel material.

12. A Zn—Al—Mg—Si alloy-plated steel material with excellent corrosion resistance according to claim 2, characterized by having a preplating layer containing one or more from among Ni, Co, Zn, Sn, Fe and Cu and/or the intermetallic compound phase comprising two or more from among Ni, Co, Zn, Sn, Fe and Cu, at the interface between the plating layer and the steel material.

13. A Zn—Al—Mg—Si alloy-plated steel material with excellent corrosion resistance according to claim 1, characterized in that the plating coverage per side is 20–130 $g/m^2$.

14. A Zn—Al—Mg—Si alloy-plated steel material with excellent corrosion resistance according to claim 2, characterized in that the plating coverage per side is 20–130 $g/m^2$.

* * * * *